United States Patent [19]

Vora et al.

[11] Patent Number: 5,019,662

[45] Date of Patent: May 28, 1991

[54] PROCESS FOR THE PRODUCTION OF WHITE OIL FROM HEAVY AROMATIC ALKYLATE

[75] Inventors: Bipin V. Vora, Darien; Dusan J. Engel, Des Plaines, both of Ill.

[73] Assignee: UOP, Des Plaines, Ill.

[21] Appl. No.: 484,027

[22] Filed: Feb. 23, 1990

Related U.S. Application Data

[63] Continuation-in-part of Ser. No. 195,913, May 19, 1988, abandoned.

[51] Int. Cl.[5] ..... C10G 23/00; C07C 1/00

[52] U.S. Cl. ..... 585/323; 585/455; 585/456; 208/268; 208/14; 208/18; 208/143; 208/58; 208/89

[58] Field of Search ..... 585/455, 456, 323; 208/14, 18, 58, 89, 143, 268

[56] References Cited

U.S. PATENT DOCUMENTS

| | | | |
|---|---|---|---|
| Re. 27,845 | 12/1973 | Gilbert et al. | 208/89 |
| 3,328,293 | 6/1967 | Brenken | 208/264 |
| 3,392,112 | 7/1968 | Bercik et al. | 208/210 |
| 3,422,162 | 1/1969 | Oldham et al. | 260/671 |
| 3,484,498 | 12/1969 | Berg | 260/671 |
| 3,629,096 | 12/1971 | Divijak | 208/89 |
| 3,658,692 | 4/1972 | Gilbert et al. | 208/89 |
| 3,705,093 | 12/1972 | Ashcraft | 208/14 |
| 3,917,540 | 11/1975 | Pollitzer | 252/466 PT |
| 4,072,603 | 2/1978 | Wentzheimer | 208/264 |
| 4,240,900 | 12/1980 | Gilbert et al. | 208/143 |
| 4,263,127 | 4/1981 | Rausch et al. | 208/58 |
| 4,318,829 | 3/1982 | Halluin et al. | 252/466 J |
| 4,520,218 | 5/1985 | Berg et al. | 585/449 |
| 4,523,048 | 6/1985 | Vora | 585/323 |

FOREIGN PATENT DOCUMENTS 1597165 9/1981 United Kingdom .

OTHER PUBLICATIONS

Chemical Tech. of Petroleum, "Miscellaneous Petroleum Products", Chapter XVI, pp. 603-605.

Standard Methods for Calculating Viscosity Index ASTM Standards, 1958, pp. 278-281.

*Primary Examiner*—Helane E. Myers

*Attorney, Agent, or Firm*—Thomas K. McBride; John F. Spears, Jr.

[57] ABSTRACT

A process for the production of hydrocarbon white oil by means of hydrogenating a heavy aromatic alkylate is disclosed. The process is characterized in that its feedstock is a previously undesired heavy hydrocarbon byproduct of aromatic alkylation. A white oil derived from such a process has good color and odor properties and results in a superior white oil lubricant.

15 Claims, 1 Drawing Sheet

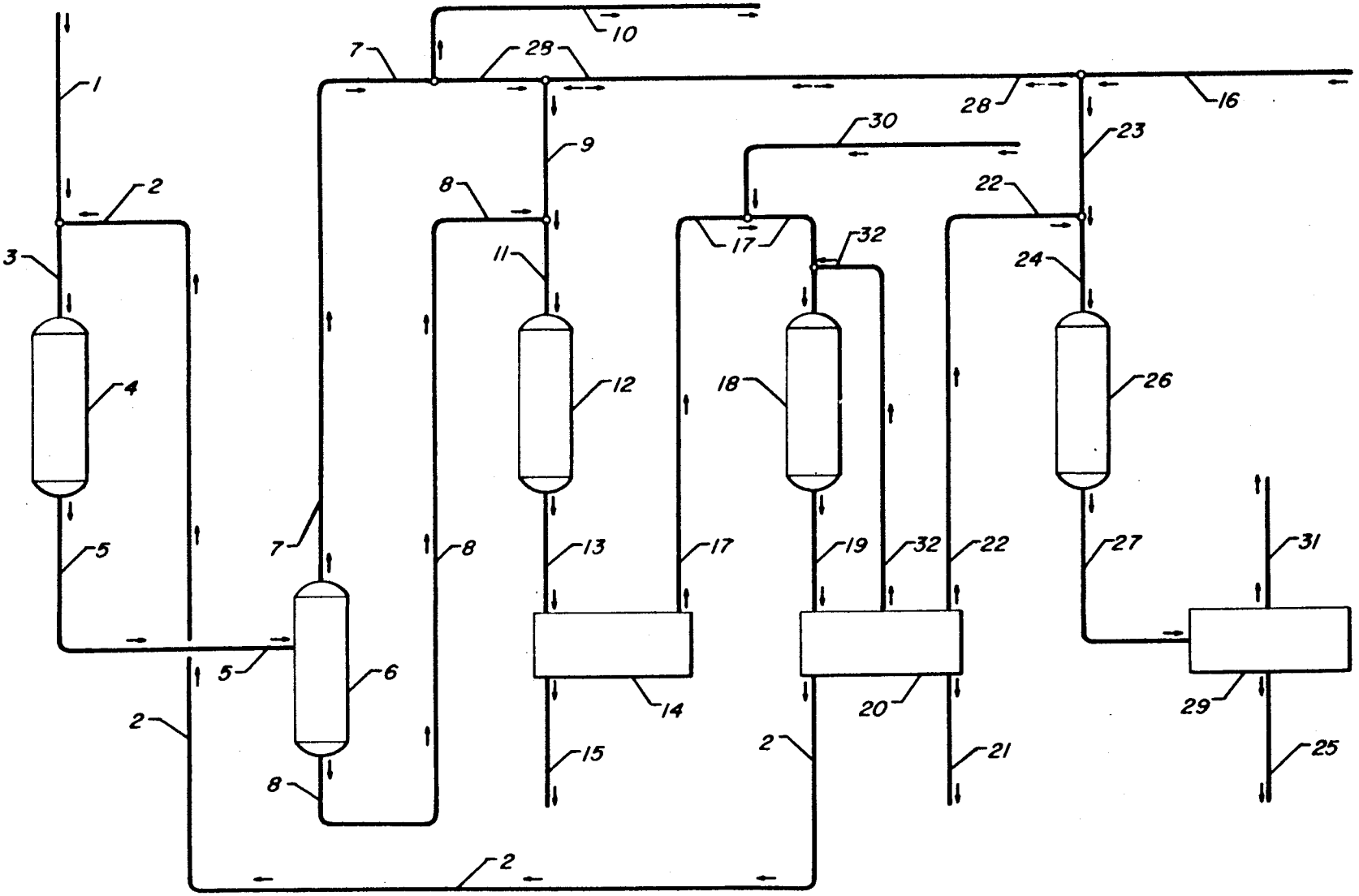
1
2
3
4
5
6
7
8
9
10
11
12
13
14
15
16
17
18
19
20
21
22
23
24
25
26
27
28
29
30
31
32

PROCESS FOR THE PRODUCTION OF WHITE OIL FROM HEAVY AROMATIC ALKYLATE

CROSS-REFERENCE TO RELATED APPLICATIONS

This application is a continuation-in-part of prior co-pending application Ser. No. 195,913 which was filed on May 19, 1988, now abandoned.

BACKGROUND OF THE INVENTION

This invention is related to the broad field of hydrocarbon conversion. The invention may also broadly be considered to be related to a process for the production of white oils from a feedstock originating from an integrated hydrocarbon conversion process. More specifically, the process relates to the production of white oils by hydrogenating a heavy hydrocarbon feedstock possessing hydrogenatable components to produce naphthenes. The hydrogenation process utilizes as feedstock the heavy hydrogenatable by-product stream of an aromatic alkylation process. The by-product stream is preferably the result of the alkylation of benzene with a hydrocarbon process stream comprising linear olefins which have previously undergone a dehydrogenation step and selective hydrogenation step. The improvement is achieved through the upgrading of the heavy hydrogenatable by-product stream of an aromatic alkylation reaction into a more valuable white oil product which comprises a substantial amount of mono-cyclic naphthenes. Additionally, the white oil product quality may be improved by first selectively hydrogenating diolefins contained in the olefin-containing hydrocarbon feed to the alkylation reaction zone of this process.

INFORMATION DISCLOSURE

The production of hydrocarbon white oils from a hydrocarbon feedstock is a well established process. The first step typically is to react a feedstock in the presence of hydrogen to remove sulfur and nitrogen compounds therefrom; and the second step is typically a hydrogenation step. Such a process is disclosed in U.S. Pat. No. 3,392,112 (Bercik et al.). The '112 patent discloses a process to convert sulfur-containing hydrocarbon feedstocks into white oils. The '112 patent teaches that an alkylate fraction boiling above the gasoline range may be converted into charcoal lighter fluid.

A process for the production of white oils comprising a single hydrogenation reaction zone is disclosed in U.S. Pat. No. 3,328,293 (Brenken). The '293 patent discloses the use of a hydrocarbon feedstock from a mineral oil distillate containing aromatics, naphthenes, and paraffins. The product of the hydrogenation reaction zone is then separated in an adsorption column to produce a napthenic fraction, a paraffinic fraction, and an aromatic fraction but only the naphthenic portion of the product is recovered as white oil. The process of the instant invention differs from that of the '293 patent, in that the feedstock to the hydrogenation reaction zone has been refined to such an extent that the hydrogen reaction zone product is predominantly naphthenic and the entire hydrogenation reaction zone product can be recovered as white oil. A sulfur-resistant hydrogenation catalyst is not required.

Other hydrogenation processes for the production of white oils are disclosed in U.S. Pat. No. Re. 27,845 (Gilbert et al.); U.S. Pat. Nos. 4,240,900 (Gilbert et al.); 3,658,692 (Gilbert et al.); 4,318,829 (Halluin et al.); and British Pat. No. 1,597,165 (Gerard et al.). The white oil production process of U.S. Pat. No. Re. 27,845 teaches the use of solvent extraction raffinate as a source of hydrogenatable oil. The instant process is directed at the use of a heavy hydrogenatable hydrocarbon prepared by means of aromatic alkylation with linear mono-olefins. Rather than using solvent extraction to reduce the proportion of aromatics in a final hydrogenation feedstream, the alkylation step of the instant process serves to maximize aromatics.

The '900 patent describes a process which utilizes a particular zeolitic catalyst with attenuated cracking activity to hydrogenate hydrocarbon oils in order to produce white oil. The '692 patent discloses a process for producing white oils by hydrogenation of solvent extraction raffinate which comprises contacting a low-sulphur feedstock with a catalyst containing iron, cobalt, or nickel. The '829 patent discloses a catalyst which is useful in hydrogenating aromatics, including aromatics in white oil base stocks. A method for hydrogenating low-aromatic content feedstock to white oil in the presence of a specific-catalyst is taught in the British '165 patent.

The white oil process feedstock characteristics are directly affected by all aspects of the combination process. The combination process useful in the instant invention for the production of a heavy white oil process feedstock is generally described in U.S. Pat. No. 4,523,048 (Vora). This reference describes the processing of a feedstock containing normal paraffin. The paraffin is first dehydrogenated, then hydrogen is separated from the dehydrogenation hydrocarbon product prior to its selective hydrogenation. The selective hydrogenation of the hydrocarbon is designed to selectively hydrogenate diolefins in order to produce a highly monoolefinic product. The olefins of selective hydrogenation reaction products are then contacted with an aromatic compound in an alkylation reaction zone to produce an alkylaromatic. The heavy by-product stream produced from the alkylation reaction is not mentioned as being a useful product important in the '048 patent. The hydrogenation of this stream is the object of this invention.

U.S. Pat. No. 4,520,218 (Berg et al.) discloses a process which comprises dehydrogenation of normal paraffins and alkylation which produces a mixture of mono- and di-alkylated hydrocarbons. It is relevant to the instant invention for its suggestion that mono-alkylated hydrocarbons can be recycled back to an alkylation zone for further alkylation.

Hydrogenation catalysts comprising in part platinum group metal components are described in the prior art. An example is U.S. Pat. No. 3,917,540 (Pollitzer) which describes a catalyst useful for hydrogenation which comprises in part a Group VIII metal on alumina. The catalyst described also comprises other catalytic modifiers such as a Group VII-B metal component.

U.S. Pat. No. 4,263,127 (Rausch et al.) is relevant to the extent that it teaches platinum and palladium catalysts may be used to selectively hydrogenate hydrocracked, hydrotreated mineral hydrocarbons to produce white mineral oil. U.S. Pat. No. 3,705,093 (Ashcraft) discloses that highly branched, low-aromatic feedstock may be hydrogenated to produce a cosmetic oil with a low viscosity index. A method of preparing linear aromatics comprising dehydrogenation of normal paraffins and alkylation is described in U.S. Pat. No. 3,484,498 (Berg).

U.S. Pat. No. 3,422,162 (Oldham et al.) explains that hydrofluoric acid is a widely used catalyst which promotes the alkylation of aromatics with olefins and that the process commonly produces a heavy alkylate stream as a by-product. U.S. Pat. Nos. 3,629,096 (Divijak) and 4,072,603 (Wentzheimer) also disclose methods of making white oil by hydrogenation.

BRIEF SUMMARY OF THE INVENTION

The invention is a process for producing linear alkyl aromatics by means of dehydrogenating normal paraffins, selectively hydrogenating dienes and trienes, and alkylating aromatics and simultaneously upgrading the byproduct of this sequence into high value products by selective hydrogenation. Heavy alkylate which is commonly produced as a by-product of aromatic alkylation has long been regarded as having little value and is usually burned for its heating value in a refinery process fuel system. The instant invention converts this apparently valueless stream into a white oil which is suitable for sale as a white oil lubricant.

In a more specific-embodiment, the instant invention maximizes production of the previously undesired heavy aromatic alkylate so that additional white oil can be recovered. This is accomplished by recycling linear mono-alkyl aromatics, which are usually regarded as the primary and most desirable product, back to the alkylation zone for successive alkylation to dialkyl aromatics and subsequent hydrogenation to white oil. The white oil produced comprises mainly mono-cyclic, linear alkyl naphthenes and a small amount of cross-polymerized linear paraffins. The white oil has lubricating properties which make it more valuable than an equal amount of linear monoalkyl aromatics.

BRIEF DESCRIPTION OF THE DRAWING

The drawing is a simplified process flow scheme which illustrates a preferred embodiment of the invention. In this embodiment, valuable white oil products are produced from a stream comprising linear paraffin hydrocarbons and a stream comprising aromatic hydrocarbons.

DETAILED DESCRIPTION

The production of a valuable hydrocarbon white oil product from a low value aromatic alkylation heavy alkylate carbon feedstock is the object of this process. More particularly, this process is directed towards the hydrogenation of a heavy alkylate by-product stream or a heavy hydrogenatable hydrocarbon as referred to below where the heavy alkylate by-product stream is produced as a result of an aromatic alkylation process which comprises the process steps of dehydrogenation and selective hydrogenation.

Conventional refining techniques, for example, HF alkylation, selective hydrogenation, and the like, have been combined, modified, and improved in order to reduce the amount of low value heavy alkylate by-products of an aromatic alkylation process. However, even with all these changes, there is still a small but significant amount of heavy alkylate by-product which must be disposed of from an aromatic alkylation process. Thus, there is a great need for a method of eliminating the production of a heavy alkylate by-product of an alkylation process.

The present invention satisfies this need by presenting a process which is capable of hydrogenating heavy alkylate to produce a valuable white oil product. According to the process of the present invention, a white oil product characterized as being essentially without aromatics and olefins is produced by hydrogenating a heavy alkylate hydrocarbon feedstock. The feedstock hydrogenated is characterized in that it is produced as a product or by-product of an aromatic alkylation process which may be operated in combination with other hydrocarbon conversion process, comprising various reaction and separation zones. In a preferred embodiment of the present invention the process employed to produce the heavy hydrogenatable hydrocarbon feedstock utilizes two feed components, a paraffin, and an aromatic hydrocarbon. These components are processed separately or together in a dehydrogenation reaction zone, a selective hydrogenation reaction zone, and in an alkylation reaction zone. The final products of this combination process include an alkylaromatic and a heavy hydrogenatable hydrocarbon.

In a broad embodiment, the invention is a process for the production of detergent alkylate wherein a dehydrogenation feed stream comprising linear paraffin hydrocarbons is dehydrogenated in a dehydrogenation zone and selectively hydrogenated in a selective hydrogenation zone to produce a first alkylation feed stream comprising linear mono-olefinic hydrocarbons and linear dienes which is alkylated in an alkylation zone with a second alkylation feed stream comprising aromatic-hydrocarbons to produce an alkylation zone effluent stream, the improvement comprising:

(a) fractionating the alkylation zone effluent stream to produce a light alkylate stream comprising linear mono-alkyl aromatic hydrocarbons and comprising substantially no di-alkyl aromatic hydrocarbons and a heavy alkylate stream comprising linear di-alkyl aromatics;

(b) passing substantially all of the heavy alkylate stream to an aromatics saturation zone where substantially all of the aromatic-hydrocarbons in the heavy alkylate stream are saturated to produce a saturation zone effluent stream but where essentially no hydrocracking, desulfurizing, or dentrifying takes place; and (c) fractionating the aromatic-saturation zone effluent to produce one or more white oil streams.

In a more specific embodiment the invention is a process for the production of white oil, which comprises:

(a) dehydrogenating a dehydrogenation feed stream comprising linear paraffinic hydrocarbons and which contains essentially no sulfur or nitrogen in a dehydrogenation zone maintained at dehydrogenation conditions to produce a dehydrogenation zone effluent stream comprising hydrogen, linear mono-olefinic hydrocarbons and dienes;

(b) separating the dehydrogenation reactor effluent stream in a first separation zone to produce at least a first overhead stream which comprises hydrogen and a first bottoms stream which is essentially sulfur-free and nitrogen-free and which comprises mono-olefinic hydrocarbons and dienes, and passing the first bottoms stream to a diene reduction zone;

(c) reducing dienes to mono-olefinic hydrocarbons or to paraffins in the diene reduction zone which operates at conditions that result in essentially no hydrocracking, to produce a diene reduction zone effluent stream;

(d) alkylating aromatic hydrocarbons with mono-olefinic hydrocarbons of the diene reduction zone effluent stream in an alkylation zone maintained at alkylating conditions to produce an alkylation zone effluent stream;

(e) separating the alkylation zone effluent stream in a second separation zone to produce at least a first alkylate stream comprising linear mono-alkyl aromatics and a second alkylate stream comprising linear di-alkyl aromatics, and passing the second alkylate which comprises essentially no sulfur or nitrogen stream to an aromatic-saturation zone;

(f) saturating aromatics which contain essentially no sulfur or nitrogen in the aromatic saturation zone at conditions which result in essentially no hydrocracking to produce an aromatic-saturation zone effluent stream; and (g) fractionating the aromatic-saturation zone effluent stream to produce one or more white oil streams, where at least one of the white oil streams has a viscosity of from about 20 to 100 cst and a viscosity index of about 50 to 110 according to American Society for Testing materials standard method D 567-53.

White oils such as those produced by the instant process are highly refined oils derived from petroleum which have been extensively treated to virtually eliminate oxygen, nitrogen, sulfur compounds and reactive hydrocarbons such as aromatic hydrocarbons. White oils fall into two classes, i.e., technical white oils which are used in cosmetics, textile lubrication, insecticide base oils, etc., and the even more highly refined pharmaceutical white oils which are used in drug compositions, foods, and for the lubrication of food handling machinery. For all of these applications, white oils must be chemically inert and without color, odor, and taste. Therefore, white oils must be essentially absent of reactive species such as aromatic and olefinic components and must meet strict specifications. White oil specifications are rather difficult to meet. For example, such oils must have a color of +30 Saybolt, and must pass the UV Absorption Test (ASTM D-2008) and the USP Hot Acid Test (ASTM D-565). The process of the present invention is able to produce a white oil product that meets or exceeds the above specifications for both technical and pharmaceutical grade white oils.

Some embodiments of the present invention are characterized in that the final white product comprises 75 mol percent or more linear di-alkyl naphthenes and linear alkyl naphthenes.

The feedstock to the dehydrogenation process of this invention as mentioned is a product or by-product of an aromatic alkylation process in combination with other unit operations as described hereinbelow. The useful heavy hydrogenatable hydrocarbon feedstock as the name implies must comprise hydrogenatable components. Such components include, but are not limited to, aromatics, polynuclear aromatics, and olefins. Other characteristics of the feedstock include a specific gravity of from 0.85 to 0.95, a kinematic viscosity of from 5 to 40 centistokes at 50° C., and a boiling point range of from 200°-650° C. The useful heavy hydrogenatable hydrocarbon feed to the hydrogenation reaction zone of this invention is further characterized in that it comprises at least 20% by weight aromatic components. It is preferred that the heavy hydrogenatable feed comprises more than 50% by weight aromatic components. The net products of a typical unit for the production of linear alkyl benzene are approximately 90% mono-alkyl benzene, 6% heavy alkylate and 3% acid tar and a small amount of hydrogen and light hydrocarbons. The scope of the subject invention covers the range where the second alkylate stream is 5 percent or more of the total net products.

The term "alkylate" has two distinct meanings which are applied by different groups of specialists to different chemical species. In the petroleum processing field, the term alkylate is understood to refer to a branched-chain paraffin produced by the chemical reaction of a paraffin with an olefin. These paraffins possess high octane ratings and are preferred components for blending gasoline. In the detergent manufacturing field, the term alkylate denotes the chemical reaction product of benzene or one of its aromatic homologs with a long-chain olefin. These alkyl benzenes are relatively biodegradable and are preferred detergent components. For the purpose of describing the present invention, the inventor has chosen to use the term "detergent alkylate" to emphasize that this invention is specifically directed to processing alkylates comprising alkyl benzenes such as those commonly produced within the detergent manufacturing industry.

It is an important aspect of this invention that the heavy hydrogenatable hydrocarbon feedstock is essentially free of sulfur and nitrogen. These elements can detrimentally affect the hydrogenation zone catalyst. By "essentially free", it is meant that the feedstock contains less than 10 ppm of either sulfur or nitrogen.

The heavy hydrogenatable hydrocarbon described above is hydrogenated in a hydrogenation reaction zone containing a hydrogenation catalyst. The hydrogenation catalyst of this invention may be any catalyst known in the prior art to have a hydrogenation function. A well known and preferred type hydrogenation catalyst comprises one or more Group VIII metal components on a catalytic support. The support can be a refractory material such as alumina, or an active material such as a crystalline aluminosilicate zeolite. The useful Group VIII metals are iron, cobalt, nickel, ruthenium, palladium, rhodium, osmium, iridium, and platinum.

A particularly preferred hydrogenation catalyst comprises from 0.05 to 5.0 wt. % of platinum and palladium combined with a non-acidic refractory inorganic oxide material such as alumina. While the precise manner by which the catalytic composite is prepared is not an essential feature of the present invention, it is preferred that the selected preparation scheme result in a catalyst particle in which the catalytically active Group VIII noble metal is surface-impregnated. This type of catalyst results in a hydrogenation process with improved product and catalyst life characteristics in comparison to those hydrogenation processes using catalysts which have been bulk-impregnated, or thoroughly impregnated within and throughout the carrier material.

It is preferred that the Group VIII metal component be present in the catalytic composite in an amount ranging from 0.05 to 1.0 wt. %. Further, it is anticipated that other catalytically active components such as alkali, or alkaline, elements or halogens and the like known catalytic components may be usefully incorporated into the instant catalyst.

Referring now to the drawing, a paraffin feed stream comprising an admixture of $C_6$-plus normal paraffins enters the process through line 1. This feed stream is admixed with recycled normal paraffins from line 2 and passed through line 3 into a dehydrogenation reaction zone 4. The paraffins are contacted with a dehydrogenation catalyst in the dehydrogenation reaction zone 4 at conditions which affect the conversion of a significant amount of the paraffins to the corresponding olefins. From the dehydrogenation reaction zone is produced a reactor effluent stream carried by line 5 which comprises a mixture of hydrogen, unconverted paraffins, $C_6$-plus monoolefins, and a smaller amount of $C_6$-plus diolefins and $C_6$-minus hydrocarbons produced as undesired by-products of the dehydrogenation reaction. This reactor effluent in line 5 is condensed in a vapor-liquid separation zone 6 wherein it is divided into a hydrogen-rich vapor phase stream removed through line 7 and a liquid phase process stream removed through line 8. The hydrogen-rich vapor phase stream 7 is divided into a net hydrogen product stream removed through line 10 and a makeup hydrogen stream for use in the selective hydrogenation reaction zone and the hydrogenation reaction zone carried by line 28.

The liquid phase process stream removed in line 8 from the bottom of the separation zone 6 contains unconverted $C_6$-plus paraffins, $C_6$-plus mono-and diolefins, lighter hydrocarbons produced as reaction by-products, and some dissolved hydrogen. A controlled volume of hydrogen from line 9 is admixed into the liquid process stream. It is then passed through line 11 into a selective hydrogenation reaction zone 12. In reaction zone 12, the liquid phase hydrocarbons and hydrogen are contacted with a catalyst under conditions which promote the selective hydrogenation of diolefins to monoolefins. The liquid phase portion effluent of the selective hydrogenation reactor is then passed through line 13 to a hydrocarbon separation means 14. In the hydrocarbon separation means, the light hydrocarbons and any remaining minor quantity of unconsumed hydrogen are separated from the $C_6$-plus hydrocarbons and concentrated into a stream removed from the process through line 15.

The remainder of the hydrocarbons (essentially $C_6$-plus hydrocarbons) entering the hydrocarbon separation means 14 are concentrated into a net bottoms stream carried by line 17. The net bottoms stream comprises an admixture of $C_6$-plus paraffins and monoolefins and has a greatly reduced concentration of diolefins compared to that of the dehydrogenation reaction zone liquid phase process stream 8. This admixture is combined with benzene from line 30 and passed into an alkylation reaction zone 18 through line 17. In the alkylation reaction zone, the benzene and olefinic hydrocarbons react in the presence of an alkylation catalyst at alkylation-promoting conditions. The alkylation reaction zone effluent stream carried by line 19 is passed into a fractionation zone 20. This alkylation reaction zone effluent stream comprises an admixture of unreacted benzene, $C_6$-plus paraffins, the product alkylbenzenes, and a heavy alkylate product which comprises hydrogenatable hydrocarbons.

The alkylation reaction zone effluent stream 19 is separated in the fractionation zone 20 into an alkylaromatic product stream carried by line 21, a $C_6$-plus paraffin recycle stream carried by line 2, heavy hydrogenatable hydrocarbon by-product stream carried by line 22, and an unconverted benzene stream which is recycled to alkylation reaction zone 18 through line 32.

The heavy hydrogenatable hydrocarbon stream of line 22 is combined with a hydrogen stream 23, and fed into a hydrogenation reaction zone 26 through line 24. In the hydrogenation reaction zone 26, the hydrogen and heavy hydrogenatable hydrocarbons are contacted with a hydrogenation catalyst under conditions which promote the hydrogenation of the heavy hydrogenatable hydrocarbon.

The hydrogenation reaction zone products comprising white oils and hydrogen is removed from the hydrogenation reaction zone 26 by line 27. The hydrogenation reaction zone products in line 27 are directed to a separation zone 29 where the white oil is recovered in line 25, and a light product comprising hydrogen is recovered in line 31.

The hydrogen supplied by line 9 as a portion of the feed to the selective hydrogenation reaction zone 12, and the hydrogen supplied by line 23 as a portion of the feed to the hydrogenation reaction zone 26 can be supplied as fresh hydrogen through line 16. Alternatively, the hydrogen may be supplied in part or totally by line 7 which is the hydrogen product of the dehydrogenation reaction zone 4 which has been recovered in the vapor-liquid separation zone 6. Regardless of the source of hydrogen, it is fed into a hydrogen supply line 28 where it supplies line 9, the hydrogen feed to the selective hydrogenation reaction zone 12, and line 23, the hydrogen feed to the hydrogenation reaction zone 26.

The preferred catalyst of this invention may be prepared by any method described in the prior art for forming a catalyst base comprising alumina and incorporating a Group VIII metal component into the base. The preferred alumina carrier material may be prepared in any suitable manner and may be synthetically prepared or naturally occurring. Whatever type of alumina is employed, it may be activated prior to use by one or more treatments including drying, calcination, steaming, etc., and it may be in a form known as activated alumina, activated alumina of commerce, porous alumina, alumina gel, etc. For example, the alumina carrier may be prepared by adding a suitable alkaline reagent, such as ammonium hydroxide to a solution of a salt of aluminum such as aluminum chloride, aluminum nitrate, etc., in an amount to form an aluminum hydroxide gel which upon drying and calcining is converted to alumina. The alumina carrier may be formed in any desired shape such as spheres, pills, cakes, extrudates, powders, granules, etc., and utilized in any desired size. For the purpose of the present invention, a particularly preferred form of alumina is the sphere. Alumina spheres may be continuously manufactured by the well-known oil drop method which comprises: forming an alumina hydrosol by any of the techniques taught in the art and preferably by reacting aluminum metal with hydrochloric acid, combining the resulting hydrosol with a suitable gelling agent and dropping the resultant mixture into an oil bath maintained at elevated temperatures. The droplets of the mixture remain in the oil bath until they set and form hydrogel spheres. The spheres are then continuously withdrawn from the oil bath and typically subjected to specific aging treatments in oil and an ammoniacal solution to further improve their physical characteristics. The resulting aged and gelled particles are then washed and dried at a relatively low temperature of about 149° to about 204° C. and subjected to a calcination procedure at a temperature of about 454° to about 704° C. for a period of about 1 to about 20 hours. It is also a good practice to subject the calcined particles to a high temperature steam treatment in order to remove as much of the undesired acidic components as possible. This manufacturing procedure effects conversion of the alumina hydrogel to the corresponding crystalline gamma-alumina. See the teachings of U.S. Pat. No. 2,620,314 for additional details.

A preferred constituent for the catalytic composite used as the hydrogenation catalyst of the present invention is a Group VIII metal component. The Group VIII metal component such as platinum may exist within the final catalytic composite as a compound such as the oxide, sulfide, halide, etc., or as an elemental metal. Generally, the amount of the Group VIII metal component present in the final catalyst is small. In fact, the Group VIII metal component generally comprises about 0.05 to about 5 percent by weight of the final catalytic composite calculated on an elemental basis. Excellent results are obtained when the catalyst contains about 0.05 to about 1 wt. % of the Group VIII metal. The preferred Group VIII component is platinum.

The Group VIII metal component may be incorporated in the catalytic composite in any suitable manner such as coprecipitation or cogelation with the carrier material, ion-exchange with the carrier material and/or hydrogel, or impregnation either after or before calcination of the carrier material, etc. The preferred method of preparing the catalyst involves the utilization of a soluble, decomposable compound of the Group VIII metal to impregnate the porous carrier material. For example, the platinum group metal may be added to the carrier by commingling the latter with an aqueous solution of chloroplatinic acid. Other water-soluble compounds of the Group VIII metals may be employed in impregnation solutions and include ammonium chloroplatinate, bromoplatinic acid, platinum chloride, dinitrodiaminoplatinum, palladium chloride, palladium nitrate, palladium sulfate, diamine palladium hydroxide, tetraminepalladium chloride, etc. The utilization of a platinum chloride compound such as chloroplatinic acid is ordinarily preferred. In addition, it is generally preferred to impregnate the carrier material after it has been calcined in order to minimize the risk of washing away the valuable platinum metal compounds; however, in some cases, it may be advantageous to impregnate the carrier when it is in a gelled state.

It is preferred that the resultant calcined catalytic composite be subjected to a substantially water-free reduction step prior to its use in the conversion of hydrocarbons. This step is designed to insure a uniform and finely divided dispersion of the metal components throughout the carrier material. Preferably, substantially pure and dry hydrogen (i.e., less than 20 vol. ppm $H_2O$) is used as the reducing agent in this step. The reducing agent is contacted with the calcined composite at a temperature of about 427° to about 649° C. and for a period of time of about 0.5 to 10 hours or more, effective to substantially reduce at least the platinum group component. This reduction treatment may be performed in situ as part of a start-up sequence if precautions are taken to predry the plant to a substantially water-free state and if substantially water-free hydrogen is used.

According to the method of the present invention, the heavy hydrogenatable hydrocarbon is contacted with a catalytic composite of the type described above in a hydrogenation zone at hydrogenation conditions. This contacting may be accomplished by using the catalyst in a fixed bed system, a moving bed system, a fluidized bed system, or in a batch-type operation; however, in view of the danger of attrition losses of the valuable catalyst and of well-known operational advantages, it is preferred to use a fixed bed system. In this system, the hydrocarbon feed stream is preheated if necessary by any suitable heating means to the desired reaction temperature and then passed into the hydrogenation zone containing a fixed bed of the catalyst type previously characterized. It is, of course, understood that the hydrogenation reaction zone may be one or more separate reactors with suitable heating or cooling means therebetween to insure that the desired conversion temperature is maintained at the entrance to each reactor. It is also to be noted that the reactants may be contacted with the catalyst bed in either upward, downward, or radial flow fashion. In addition, it is to be noted that the reactants may be in the liquid phase, a mixed liquid-vapor phase, or a vapor phase when they contact the catalyst, with best results obtained in the mixed phase.

Hydrogen is a cofeed to the hydrogenation reaction zone of this invention. Hydrogen is fed along with the heavy hydrogenatable hydrocarbon into the reaction zone. The hydrogen to heavy hydrogenatable hydrocarbon feed mole ratio may vary from 1 to 100 with a value between 5 and 20 being preferred. Additionally, the hydrogenation of the heavy hydrogenatable hydrocarbons may occur at hydrocarbon conversion conditions including a temperature of from 150° to 300° C., a pressure of from 34 to 136 atmospheres, and a liquid hourly space velocity (calculated on the basis of the volume amount, as a liquid, of heavy hydrogenatable hydrocarbon charged to the hydrogenation zone per hour divided by the volume of the catalyst bed utilized) selected from the range of about 0.05 to about 5 $hr^{-1}$. However, the hydrogenation process conditions of this invention are typically low in severity because the hydrogenation process of the present invention is preferably accomplished with a heavy hydrogenatable hydrocarbon comprising essentially no sulfur. The preferred hydrogenation process conditions include a temperature of from 175° to 300° C., a pressure of from 68 to 136 atmospheres, and a liquid hourly space velocity of from 0.05 to 0.5 $hr^{-1}$.

Regardless of the details concerning the operation of the hydrogenation step, an effluent stream will be withdrawn from the hydrogenation reaction zone. This effluent will comprise hydrocarbon white oils and hydrogen. This stream is passed to a separation zone wherein a hydrogen-rich vapor phase is allowed to separate from a hydrocarbon white oil product. In general, it may be desired to recover various fractions of the hydrocarbon white oils from the hydrocarbon white oil phase in order to make the hydrogenation process economically attractive. This recovery step can be accomplished in any suitable manner known to the art such as by passing the hydrocarbon white oils through a bed of suitable adsorbent material which has the capability to selectively retain naphthenic or paraffinic white oils contained therein or by contacting same with a solvent having a high selectivity for either the paraffinic or naphthenic white oils or by a suitable fractionation scheme where feasible.

The process of the present invention is characterized in that the heavy hydrogenatable hydrocarbon feed to the hydrogenation reaction zone originates as a product of an aromatic alkylation reaction. Preferably the heavy hydrogenatable hydrocarbon results as a by-product from a combination of reaction and separation zones normally used to produce alkylaromatics. Such a heavy hydrogenatable hydrocarbon by-product of an alkylaromatic production process had previously been utilized as a low value lubricant, or disposed of as fuel. The process of this invention is capable of converting this by-product into a high value white oil. Further, the process of this invention can convert this by-product into a white oil with properties that make it suitable as a lubricant. The while oil so produced can be fractionated to produce products having a viscosity in the range from about 40 to 100 centistokes and having a viscosity index of from about 50 to 100 according to American Society for Testing Materials standard method D 567-53. In a preferred emodiment, white oil can be produced which has a viscosity within the range of from about 80 to 120 and a viscosity index within the range of from about 50 to 100.

The heavy hydrogenatable hydrocarbon feed of this invention is prepared by a combination alkylaromatic production process. A preferred embodiment of the invention may accordingly be characterized as a process for the production of alkylbenzenes which comprises the steps of passing a paraffin feed stream which comprises at least one $C_6$-plus linear paraffinic hydrocarbon through a dehydrogenation reaction zone and forming a vapor phase dehydrogenation reaction zone effluent stream which comprises a mixture of hydrogen, mono- and diolefinic $C_6$-plus linear hydrocarbons, and $C_6$-plus linear paraffins; separating hydrogen from the dehydrogenation reaction zone effluent stream by partially condensing the dehydrogenation reaction zone effluent stream and separating the resultant two-phase admixture in a vapor-liquid separation zone and forming a vapor phase stream which is rich in hydrogen and a liquid phase process stream comprising $C_6$-plus linear paraffins, dissolved hydrogen, and mono- and diolefinic $C_6$-plus linear hydrocarbons; passing the liquid phase process stream through a selective hydrogenation zone maintained at diolefin selective hydrogenation conditions and in which the liquid phase process stream is contacted with a solid selective hydrogenation catalyst and thereby forming a selective hydrogenation zone effluent stream which contains fewer $C_6$-plus diolefinic hydrocarbons than the selective hydrogenation zone feed; removing substantially all free hydrogen and $C_6$-minus hydrocarbons from the hydrogenation zone effluent stream by passing the hydrogenation zone effluent stream into a light ends stripping column, and producing a stripping column bottoms stream which comprises a mixture of $C_6$-plus monoolefinic linear hydrocarbons and $C_6$-plus linear paraffins; contacting the stripping column bottoms stream with an alkylation catalyst and with an aromatic hydrocarbon such as benzene within an alkylation zone maintained at alkylation-promoting conditions, and producing an alkylation zone effluent stream which comprises $C_6$-plus linear paraffins, alkylbenzenes, a heavy hydrogenatable hydrocarbon by-product and unreacted aromatic hydrocarbons, and recovering the heavy hydrogenatable hydrocarbon from the alkylation zone effluent stream.

The dehydrogenation section of the combination process will preferably be configured such that a fresh paraffinic hydrocarbon feed stream comprising mainly linear molecules is combined with recycled hydrogen and recycled unconverted hydrocarbons from the alkylation section. This forms the reactants stream which is heated and is then passed through a bed of a suitable catalyst known in the art and maintained at the proper dehydrogenation conditions of temperature, pressure, etc. The effluent of this catalyst bed or reactor effluent stream is cooled and partially condensed. Part of the uncondensed material is employed as the hydrogen-rich recycle gas stream. The remainder of the uncondensed hydrogen-rich material is the net production of hydrogen which may be used in other applications within the process such as in the hydrogenation or selective hydrogenation reaction zones, or outside the process disclosed herein such as in a desulfurization process. In one embodiment of the present invention, the uncondensed hydrogen-rich material is divided into portion with a first portion being passed to the diene reduction zone and a second portion being passed to the aromatic-saturation zone. As used herein, the term "rich" is intended to indicate a molar concentration of the indicated compound or class of compounds above 50%. The separation zone also produces a liquid stream referred to herein as the liquid phase process stream. The stream is basically an admixture of dehydrogenated and undehydrogenated acyclic hydrocarbons. This liquid phase stream will also contain some dissolved hydrogen and light hydrocarbons produced by various cracking reactions which occur at the high temperatures employed in the dehydrogenation reactor.

The liquid phase process stream withdrawn from this separation zone is passed into a selective hydrogenation reaction zone. This zone contains a selective hydrogenation catalyst and is maintained at conditions necessary for selective hydrogenation of diolefins to monoolefins. The selective hydrogenation zone is characterized in that double and triple carbon-to-carbon chemical bonds are saturated to single or double bonds by reacting with hydrogen and in that essentially no hydrocracking or desulfurizing or denitrifying takes place. The selective hydrogenation conditions employed in the hydrogenation zone are preferably similar to that maintained in the vapor-liquid separation zone of the prior art processes. More specifically, the minimum pressure should be sufficient to maintain the reactants as liquid phase hydrocarbons. A broad range of suitable operating pressures therefore extends from about 3 to about 70 atmospheres, with a pressure between about 3.5 and 21 atmospheres being preferred. A relatively moderate temperature between about 25° and 250° C. is preferred. More preferably, the hydrogenation zone is maintained at a temperature between about 150° and about 250° C. The liquid hourly space velocity of the reactants through the selective hydrogenation zone should be above 1.0 $hr^{-1}$. Preferably, it is above 3.0 and more preferably it is between 5.0 and 35.0 $hr^{-1}$. The optimum set of conditions will of course vary depending on such factors as the composition of the feed stream and the activity and stability of the hydrogenation catalyst.

Another operating condition which may vary depending on catalyst is the ratio of hydrogen to diolefinic hydrocarbons maintained within the selective hydrogenation zone. Some catalysts, such as a palladium on alumina catalyst, require a higher hydrogen concentration to achieve the desired degree of hydrogenation. Therefore, with some catalysts such as the palladium catalysts, it may be desired to operate with a hydrogen to diolefinic hydrocarbon mole ratio of between 2:1 and 5:1. With this catalyst, it was determined that hydrogen concentrations above this range resulted in the saturation of a significant amount of monoolefinc hydrocarbons. This of course is undesirable as it reduces the yield of the process. With the preferred nickel sulfide catalyst, there should be less than 2.0 times the stoichiometric amount of hydrogen required for the selective hydrogenation of the diolefinic hydrocarbons which are present in the liquid phase process stream to monoolefinic hydrocarbons. Preferably, the mole ratio of hydrogen to diolefinic hydrocarbons in the material entering the selective hydrogenation zone is maintained between 1:1 and 1.8:1. In some instances, it may be desirable to operate with a less than stoichiometrically required amount of hydrogen, with mole ratios down to 0.75:1 being acceptable.

The selective hydrogenation zone preferably comprises a single fixed bed reactor containing a cylindrical bed of catalyst through which the reactants move preferably in a vertical direction.

It is preferred that the active catalytic metal component present in the selective hydrogenation catalyst is either nickel or palladium, with nickel being especially preferred. When non-noble metals are employed, the catalyst should have a high concentration or loading of the active metal, with the metal component preferably comprising over 5 wt. % of the catalytic composite and in some cases, it is preferred that over 20 wt. % of the catalytic composite is metallic. It is very highly preferred that the selective hydrogenation catalyst also comprises a sulfur component. The preferred catalyst may therefore be described as a sulfided nickel catalyst. The preparation of catalysts of this nature is described in U.S. Pat. No. 3,919,341. The preferred selective hydrogenation catalyst has a lower sulfur concentration than the catalyst described in this reference, with sulfur levels between about 0.1 and 0.4 wt. % being preferred. The basic function of the sulfur component is believed to be the attenuation of the hydrogenation activity of the nickel. It is known in the art that carbon monoxide may be passed into a selective hydrogenation reactor for the purpose of moderating or attenuating the hydrogenation reaction. The use of carbon monoxide and other such moderators though not necessary may be employed.

The selective hydrogenation catalyst also comprises a support or carrier material which should be relatively inert and refractory to the conditions employed within the process. Such support materials include various clays, diatomaceous earth, aluminas, ceramics, attapulgus clay, and other synthetically prepared or naturally occurring silicates, kaolin, kieselguhr, titania, alumina, crystalline aluminosilicates, and admixtures of two or more of these materials.

The effluent of the selective hydrogenation zone is a liquid phase stream similar in nature to the liquid phase process stream removed from the separator but having a reduced concentration of diolefinic hydrocarbons and a corresponding increase in the concentration of monoolefinic hydrocarbons. This effluent stream is passed into a stripping column designed and operated to remove all compounds which are more volatile than the lightest normal hydrocarbon which it is desired to charge to the alkylation section of the integrated process. These lighter materials will be concentrated into a net overhead stream which will comprise a trace to minor quantities of hydrogen and light hydrocarbons. The purpose of the stripping operation is to prevent the entrance of light, volatile materials into the alkylation zone where they would present certain operational problems and also to eliminate the light hydrocarbons from the recycle stream which returns unconverted paraffinic hydrocarbons to the dehydrogenation zone. The passage of light monoolefins into the alkylation zone would also lead to the production of an increased amount of undesired side products through alkylation and polymerization reactions.

The alkylation section comprises an alkylation zone and a fractionation or alkylate recovery zone. The alkylation zone can have a number of different configurations depending on the catalyst and reactor vessels which are employed. A solid alkylation catalyst could be employed in the alkylation zone. For example, one current trend in heterogeneous alkylation catalysts is the use of a zeolitic catalyst as described in U.S. Pat. Nos. 3,751,506; 4,387,259; and 4,409,412.

When a solid alkylation catalyst is used in the alkylation reaction zone, the process operating conditions are typically different from those when a liquid acid alkylation catalyst is utilized. In a solid catalyst alkylation reaction zone, the starting aromatic compound(s) and the alkylating agent are contacted with the catalyst in an alkylation zone maintained at elevated temperature, e.g., from about 180° C. to about 450° C. and preferably from about 210° C. to about 400° C. Pressure within the alkylation zone can vary widely and pressures on the order of from atmospheric to about 100 atmospheres, advantageously from about 6 to about 60 atmospheres, generally provide good results. The amount of catalyst required can also vary and for practical rates of conversion, will ordinarily be sufficient to provide a gas hourly space velocity (GHSV) at standard temperature and pressure (STP) of from about 30 to about 10,000 and preferably from about 100 to about 3,000. It is preferred to use a stoichiometric excess of aromatic compound(s) compared to the carbon oxide(s) content of the alkylating agent in order to insure maximum consumption of the latter. Suitable mole ratios of aromatic compound(s) to carbon oxide(s) range from about 0.1 to about 20 and preferably from about 0.2 to about 5.

The heterogeneous catalyst can be contained as a fixed bed, a fluidized bed or a liquid slurry reactor may be used. The product stream containing the alkylaromatic mixture, unreacted gases, and steam can be cooled and the hydrocarbons recovered by any of the techniques known in the art.

The feed to the alkylation reaction zone comprises linear olefinic hydrocarbons that typically have carbon numbers of 6 or more, and such as aromatic hydrocarbons benzene, toluene, naphthalene, xylene, and cumene. The olefinic feed will normally originate as a product of the dehydrogenation or selective hydrogenation reaction zones described above. However, it is equally feasible to introduce an olefin feed into the alkylation reaction zone which has been procured in concentrated form or otherwise, from an outside source such as higher linear detergent olefins produced from ethylene, branched olefins produced via propylene or ethylene oligomerization, or propylene tetramers, thus eliminating the necessity of the unit operations prior to the alkylation reaction zone.

As mentioned, benzene is the preferred aromatic hydrocarbon feed component to the alkylation reaction zone of this invention. However, aromatic hydrocarbons besides benzene can have equal utility in an alkylation reaction zone and would produce a heavy alkylate that could be hydrogenated into a white oil. It is contemplated that a variety of aromatics could be useful as one of the feed components to the alkylation reaction zone of this process. Such aromatics might include xylenes, toluene, monoalkylaromatics, polyalkylated aromatics, naphthalene, and the like aromatic compounds.

While the use of a solid alkylation catalyst is a possible embodiment of the process of this invention, it is preferred that a liquid acid alkylation catalyst such as hydrofluoric acid, aluminum chloride, sulfuric acid, or the like be used, with hydrofluoric acid being preferred. Chemical reactions which involve olefinic hydrocarbons and are catalyzed by hydrogen fluoride usually proceed at a very fast rate. To reduce the amount of olefin polymerization and to promote the production of a monoalkylated aromatic product, the reactants are normally subjected to vigorous mixing and agitation at the point of initial contact of the olefinic hydrocarbons and the liquid phase hydrogen fluoride. The desired result is a uniform dispersion and intimate contacting of the hydrocarbon and hydrogen fluoride phases and the avoidance of localized high temperatures or localized high concentrations of either the olefinic hydrocarbon or the hydrogen fluoride.

The alkylation zone preferably has an overall arrangement similar to that shown in previously referred to U.S. Pat. No. 3,494,971 and an improvement to this is shown in U.S. Pat. No. 4,225,737, both of which are incorporated herein by reference.

The alkylation reactor and the contactor are maintained at alkylation-promoting conditions. One or more alkylation reactors and contactor may be employed. As used below, the term "alkylation-promoting conditions" is intended to include a pressure sufficient to maintain the reactants and HF in a liquid phase. A general range of operating pressures is from about 2 to 41 atmospheres absolute. The temperature range covered by this set of conditions is from about −20° to about 95° C., but the reaction is preferably conducted at a temperature of from 15° to 50° C. The volumetric ratio of HF to the total amount of hydrocarbons entering the reactor should be maintained within the broad range of from about 0.2:1 to about 10:1. A preferred range for this ratio is from 1:1 to 2.5:1. To lessen the production of polyalkylated benzenes and to reduce the amount of olefin polymerization in the reactor, the mole ratio of aromatic to the olefin at the point of initial olefin-acid contact is maintained above 1:1, but preferably below 10:1. A range of typical commercial ratios is from 3:1 to about 8:1. However, this ratio could conceivably be operated much lower if polyalkylated aromatics are the desired alkylation reaction product as in some cases it may be. For the cases where poly alkylated aromatics are the desired reaction product, a benzene to olefin ratio of about 0.2 to 3.0 in the last alkylation reactor would be appropriate.

The effluent streams leaving the reactor and the contactor will typically be an intimate admixture of liquid phase hydrocarbons and liquid phase hydrogen fluoride. They may be in the form of a true emulsion. A considerable residence time is normally required to separate these two liquid phases, and the effluent streams are therefore passed into quiescent settling zones. One or more settling zones are employed and they will normally be maintained at a temperature which is set by the entering HF-hydrocarbon mixtures withdrawn from the respective upstream vessels. They will therefore be at substantially the same temperature as the immediately upstream reaction or contacting zone. The same is also normally true for the pressures used in the settling zones after adjustment for any pressure change due to liquid flow and elevation differences. The settling zones may however be downstream of control valves and therefore operated at a somewhat reduced pressure. This reduced pressure, however, must be superatmospheric and sufficient to maintain liquid phase conditions. A residence time for both the acid and hydrocarbon phases in the settling zones should be in excess of 90 seconds but less than 30 minutes.

The hydrocarbonaceous phase removed from the second settling zone is preferably passed into a fractionation column commonly referred to as the HF stripping column. This column derives its name from its basic function in the prior art of preventing the passage of HF into the downstream fractionation zone. Representative conditions for the operation of the HF stripping column include an overhead vapor temperature of about 121° C. and a pressure of approximately 2.5 atmospheres. There is normally no external reflux to this column. The overhead vapor stream of the HF stripping column is normally completely condensed by cooling it to about 38° C. or less and is then decanted and recirculated as described above. The entire hydrocarbonaceous effluent of the second settling zone is normally passed onto the top tray of this column. The net bottoms stream of this column contains the traditional product alkylate, which is often called light alkylate and comprises mainly linear mono-alkyl aromatics.

Fractionation systems and conditions suitable for use as an effective separation zone to separate and recover the heavy hydrogenatable hydrocarbon by-product of the alkylation reaction from the alkylate in the HF stripping column bottoms stream are described in U.S. Pat. Nos. 3,950,448; 4,237,327; and 4,237,328. For instance, the bottoms stream of the HF stripping column is preferably passed into a second fractionation column referred to as a benzene column. The benzene column is operated under conditions effective to cause the division of the entering hydrocarbons into a high purity benzene stream which is removed as the overhead liquid and recycled back to the alkylation reaction zone as a feed component, and a bottoms stream comprising heavy alkylate and light alkylate. This bottoms stream is passed into a third fractionation column referred to as a paraffin column. The unreacted paraffins are removed as an overhead liquid stream and typically recycled back to the dehydrogenation reaction zone. The bottoms stream of the third fractionation column comprises the light alkylate and the heavy alkylate by-product of the alkylation reaction. This bottoms stream is passed into a fourth fractionation column from which the light alkylate product is withdrawn overhead, and from which the heavy alkylate is withdrawn from the bottoms. At this point, the heavy alkylate is directed to the hydrogenation reaction zone described hereinabove for conversion into a white oil product. The light alkylate may either be retained as a valuable net product, hydrogenated to white oil along with the heavy alkylate, or recycled to the alkylation zone. It is within the scope of some embodiments of the present invention that at least a portion of the light alkylate stream is recycled to the alkylation zone. There, it can be further alkylated to produce additional heavy alkylate. A preferred method of accomplishing this further alkylation to heavy alkylate is to utilize an alkylation zone that comprises two or more distinct reactors each of which operates at a different olefin to aromatic molar ratio, and to pass that portion of the light alkylate stream which is recycled to the alkylation zone to the reactor operating at the highest olefin to aromatic molar ratio. Where the alkylation zone comprises reactors operating at different olefin to aromatic molar ratios, it is strongly preferred that said light alkylate is not recycled to the reactor operating at the lowest olefin to aromatic ratio.

It is a characteristic of the instant process that the hydrogenation reaction zone can accept as feed a heavy hydrogenatable hydrocarbon of varying properties. In some embodiments of the invention, all of the second alkylate stream is passed to the aromatic saturation zone. With this in mind, it is possible that the processing conditions of the combination of reaction and separation zones used to produce the heavy hydrogenatable hydrocarbon may be varied to modify the physical properties of the heavy hydrogenatable hydrocarbon feed to the hydrogenation reaction zone. For example, the selective hydrogenation reaction zone may be operated at low severity to produce a larger quantity of higher boiling heavy hydrogenatable hydrocarbons. Similarly, the same selective hydrogenation zone may be operated at high severity such that a smaller volume of a lower boiling point, heavy hydrogenatable hydrocarbon by-product is produced. It is anticipated that the paraffin dehydrogenation zone or alkylation zone could be operated at conditions such that the conversion products formed will promote the increased production of a heavy hydrogenatable hydrocarbon useful in the production of white oil. In fact, it is possible that this process could be operated to produce heavy hydrogenatable hydrocarbons as the primary product of the combination reaction and separation zones as opposed to alkylaromatics. The heavy hydrogenatable hydrocarbons produced would feed the hydrogenation zone making white oils the desired product of the entire reaction.

The following examples are introduced primarily for exemplifying the method and utility of the process of the present invention.

EXAMPLE I

This example discloses the details of a combination process useful for producing the heavy hydrogenatable hydrocarbon by-product stream useful as the feedstock to the hydrogenation reaction zone of Example II. The combination process includes a paraffin dehydrogenation reaction zone followed by an aromatic alkylation reaction zone.

Table 1 establishes the component feed rates of the various unit operations of this continuous process. To briefly summarize, a feedstock comprising primarily $C_{10}$–$C_{14}$ paraffins is directed into a dehydrogenation reaction zone. The feedstock is then contacted with a dehydrogenation catalyst prepared by the method as set forth in U.S. Pat. No. 4,486,547 to Imai et al. The dehydrogenation conditions employed in the dehydrogenation reaction zone included a hydrogen-to-hydrocarbon molar feed ratio of 6:1, a liquid hourly space velocity of 20 $hr^{-1}$ based upon the combined feed rate, an inlet temperature of from 455° to 515° C., and a pressure at the outlet of the reactor of 1.35 atmospheres.

The dehydrogenation reaction zone effluent stream comprises hydrogen, light hydrocarbons, $C_{10}$–$C_{14}$ paraffins, and olefins, as well as diolefins and heavier components. The dehydrogenation reaction zone effluent stream is then directed to a stripping zone operated at conditions sufficient to remove $C_{10}$-minus light ends from the stream as an overhead product while the stripper bottoms stream is directed to the alkylation reaction zone as an alkylation reaction zone feedstock.

The stripper bottoms stream along with a fresh benzene stream are both fed into an alkylation reaction zone catalyzed with hydrofluoric acid and operating at alkylation reaction conditions. The alkylation reaction zone operating conditions include a benzene-to-olefin molar feed ratio of 6:1, an HF acid-to-hydrocarbon volumetric feed ratio of 1.5:1, all at a temperature of about 38° C. and a pressure of 10 atmospheres.

The alkylation reaction zone product is directed to a series of distillation columns operated at conditions sufficient to effect the separation of a benzene drag stream, a paraffinic hydrocarbon stream, a linear alkylated benzene product stream, and a heavy hydrogenatable hydrocarbon by-product stream. From Table 1, it can be seen that the hydrogenatable hydrocarbon by-product stream comprises over 6 wt. % of the products of the combination process. It is this stream that is hydrogenated to produce a highly valuable white oil product in Example II.

TABLE 1

| | Dehydrogenation Reaction Zone | |
|---|---|---|
| | Dehydrogenation Fresh Feed | Product Light Ends |
| Hydrogen | 0. | 740. |
| $C_1$ Light Ends | 0. | 119. |
| $C_2$ Light Ends | 0. | 608. |
| $C_3$ Light Ends | 0. | 358. |
| $C_4$ Light Ends | 0. | 362. |
| $C_5$ Light Ends | 0. | 362. |
| $C_6$ Light Ends | 0. | 362. |
| $C_7$–$C_{10}$ Light Ends | 0. | 1087. |
| $NC_{10}H_{22}$ | 6912. | 178. |
| $NC_{11}H_{24}$ | 16390. | 59. |
| $NC_{12}H_{26}$ | 17377. | 14. |
| $NC_{13}H_{28}$ | 17413. | 0. |
| $NC_{14}H_{30}$ | 587. | 0. |
| Cyclo-Paraffins | 299. | 27. |
| Iso-Paraffins | 599. | 55. |
| Aromatics | 299. | 14. |
| $NC_{10}H_{20}$ | 0. | 27. |
| $NC_{11}H_{22}$ | 0. | 9. |
| $NC_{12}H_{24}$ | 0. | 5. |
| $NC_{13}H_{26}$ | 0. | 0. |
| $NC_{14}H_{28}$ | 0. | 0. |
| Cyclo-Olefins | 0. | 9. |
| Iso-Mono-Olefins | 0. | 18. |
| Di-Olefins | 0. | 4. |
| Alkeno-Aromatics | 0. | 5. |

TABLE 1-continued

| Dehydrogenation Reaction Zone | | | | | |
|---|---|---|---|---|---|
| Total (MT/Year) | | 59877. | | 4423. | |
| Lbs./Hr. | | 16667. | | 1248. | |
| Density (g/cc) | | 0.7514 | | | |
| BPSD | | 1520. | | | |
| | Fresh Benzene to Alky | Benzene Drag Stream | Alky Regen. Bottoms | Rerun Column Overhead Product | Rerun Column Hydrogenatable By-Product |
| $NC_{10}H_{22}$ | 0. | 0. | 6. | 0. | 0. |
| $NC_{11}H_{24}$ | 0. | 0. | 12. | 0. | 0. |
| $NC_{12}H_{26}$ | 0. | 0. | 11 | 0. | 0. |
| $NC_{13}H_{28}$ | 0. | 0. | 9. | 0. | 0. |
| $NC_{14}H_{30}$ | 0. | 0. | 0. | 0. | 0. |
| Cyclo-Paraffins | 0. | 0. | 0. | 0. | 0. |
| Iso-Paraffins | 0. | 0. | 1. | 0. | 0. |
| Aromatics | 0. | 0. | 71. | 0. | 0. |
| $NC_{10}H_{20}$ | 0. | 0. | 0. | 0. | 0. |
| $NC_{11}H_{22}$ | 0. | 0. | 0. | 0. | 0. |
| $NC_{12}H_{24}$ | 0. | 0. | 0. | 0. | 0. |
| $NC_{13}H_{26}$ | 0. | 0. | 0. | 0. | 0. |
| $NC_{14}H_{28}$ | 0. | 0. | 0. | 0. | 0. |
| Cyclo-Olefins | 0. | 0. | 0. | 0. | 0. |
| Iso-Mono-Olefins | 0. | 0. | 0. | 0. | 0. |
| Di-Olefins | 0. | 0. | 0. | 0. | 0. |
| Alkeno-Aromatics | 0. | 0. | 0. | 0. | 0. |
| Benezene | 24861. | 685. | 262. | 0. | 0. |
| Cyclo-Hexane | 50. | 36. | 14. | 0. | 0. |
| $NC_{10}H_{21}$ - LAB | 0. | 0. | 35. | 8794. | 0. |
| $NC_{11}H_{23}$ - LAB | 0. | 0. | 81. | 20274. | 0. |
| $NC_{12}H_{25}$ - LAB | 0. | 0. | 82. | 20510. | 0. |
| $NC_{13}H_{27}$ - LAB | 0. | 0. | 78. | 19464. | 0. |
| $NC_{14}H_{29}$ - LAB | 0. | 0. | 2. | 137. | 479. |
| Iso-Alkyl-Benzene | 0. | 0. | 8. | 2071. | 14. |
| Indanes & Tetralins | 0. | 0. | 2. | 577. | 4. |
| Heavy Alkylate | 0. | 0. | 1993. | 173. | 4477. |
| Total (MT/Year) | 24911. | 721. | 2668. | 72000. | 4974. |
| Lbs./Hr. | 6934. | 201. | 743. | 20042. | 1385. |
| Density (g/cc) | 0.8842 | 0.8794 | 0.8756 | 0.8600 | 0.8780 |
| BPSD | 538. | 16. | 58. | 1597. | 108. |

EXAMPLE II

In this example, a commercial heavy hydrogenatable hydrocarbon such as that produced in Example I is converted into a white oil product in a hydrogenation reaction zone. The heavy hydrogenatable hydrocarbon used in this example is the heavy alkylate by-product of an aromatic alkylation combination process. The combination alkylation process utilized comprised a paraffin dehydrogenation reaction zone, a selective hydrogenation reaction zone for converting diolefins into monoolefins, and an HF alkylation reaction zone where the monoolefins and benzene were alkylated. In this particular combination process, the selective hydrogenation reaction zone was operated such that essentially all of the diolefins produced in the dehydrogenation reaction zone were hydrogenated to monoolefins in the selective hydrogenation reaction zone. The heavy alkylate resulting from this combination process has the following properties:

TABLE 2

| | |
|---|---|
| Analysis | |
| Sp. Gr. | 0.872 |
| Br. No. | 0.5 |
| Saybolt Color | Too Dark |
| Total Aromatics, wt. % | 55.2 |
| Mono alkylbenzene, wt. % | 2.4 |
| Viscosity | |
| CST at 38° C. | 22.3 |
| CST at 50° C. | 14.0 |
| Distillation, °C. | |
| IBP | 343 |
| 10 | 366 |

TABLE 2-continued

| | |
|---|---|
| 50 | 389 |
| 90 | 426 |
| EP | 495 |

The feedstock thus produced is then hydrogenated in a hydrogenation reaction zone to produce a white oil product. The hydrogenation reaction was carried out in a pilot plant comprising a reactor and product separation facilities. The charge stock was passed into a reaction zone contacted with 50 cc of a hydrogenation catalyst prepared as set forth below. The effluent from the reaction zone was thereafter separated (gases from liquids) and the products analyzed.

The hydrogenation catalyst used in the example comprised platinum on a spherical alumina support. The spherical alumina support was prepared according to the well-known oil-drop method. A platinum component was then incorporated in the support such that the platinum content of the hydrogenation catalyst was 0.4 wt. %.

The reaction zone containing the above catalyst was maintained at a hydrogen partial pressure of 102 atmospheres. The heavy alkylate charge stock identified above was passed into the reaction zone at a rate sufficient to produce a liquid hourly space velocity of 0.15 to 0.2 $hr^{-1}$. Hydrogen was fed to the reaction zone at a rate sufficient to provide a molar hydrogen to hydrocarbon ratio of about 10.0 and the feedstock was contacted with the catalyst at a temperature of about 200° C.

The white oil product of the reaction zone was then collected and analyzed. A comparison of the product white oil properties, and typical white oil specifications are found in Table 3 below.

TABLE 3

| White Oils Comparison | | |
|---|---|---|
| Analysis | Typical White Oil Specifications | White Oil from Heavy Alkylate |
| °API | 28.5–40.2 | 33.3 |
| Flash Point, °C. (min.) | 185 | 188 |
| Viscosity CST, 38° C. | 27.5 | 25.5 |
| Viscosity SUS, 38° C. | 125–135 | 131.3 |
| Color, Saybolt (min.) | 30 | 30 |
| ASTM-D565 Carbon Subst. | Pass | Pass |
| Alkylbenzene, ppm | 270 | 60–90 |
| Naphthalene, ppm | 15 | 8–10 |
| Bromine Index | — | 1–2 |
| Odor | None | None |
| UV Absorbance, 280–360 nM | 0.187 | 0.05–0.1 |

From Table 3, it is clear that the product of the hydrogenation zone meets all requirements for NF grade white oil. Thus, a heavy alkylate produced by the instant process that is too dark to determine a Saybolt color, and that has a total aromatics content of 55.2 wt. % is easily converted via hydrogenation into a colorless, high value white oil having an alkylbenzene content of only 60–90 ppm.

EXAMPLE III

In this example, a commercial heavy hydrogenatable hydrocarbon sample taken from the same commercial stream and produced by the same commercial unit as that in Example II was subjected to the hydrogenation catalyst and conditions described in Example II. Once again, liquid products of the hydrogenation reaction zone were separated from gaseous products but in this example the liquid products were further fractionated to produce white oil fractions suitable for use as lubricating oil. Table 4 discloses the viscosity and viscosity index of the various white oil fractions, which are labelled according to volume percent of the original hydrogenation zone liquid product remaining in the distillation apparatus after some amount has been distilled off.

TABLE 4

| Lubricating Properties of White Oil Fractions | | |
|---|---|---|
| Volume Percent of Liquid Product Remaining | Viscosity in Centistokes at 100° F. | Viscosity Index by ASTMD 567-53 |
| 100 | 25 | 53 |
| 70 | 42 | 65 |
| 60 | 43 | 66 |
| 50 | 52 | 70 |
| 30 | 73 | 81 |

What is claimed is:

1. In a process for the production of detergent alkylate wherein a dehydrogenation feed stream comprising linear paraffin hydrocarbons is dehydrogenated in a dehydrogenation zone and selectively hydrogenated in a selective hydrogenation zone to produce a first alkylation feed stream comprising linear mono-olefinic hydrocarbons and linear dienes which is alkylated in an alkylation zone with a second alkylation feed stream comprising aromatic-hydrocarbons to produce an alkylation zone effluent stream, the improvement comprising:

(a) fractionating the alkylation zone effluent stream to produce a light alkylate stream comprising linear mono-alkyl aromatic hydrocarbons and comprising substantially no di-alkyl aromatic hydrocarbons and a heavy alkylate stream comprising linear di-alkyl aromatics as a major component;

(b) passing substantially all of the heavy alkylate stream to an aromatics saturating zone where substantially all of the aromatic-hydrocarbons in the heavy alkylate stream are saturated to produce a saturation zone effluent stream but where essentially no hydrocracking, desulfurizing, or dentrifying takes place; and (c) fractionating the aromatic-saturation zone effluent to produce one or more white oil streams.

2. The process of claim 1 further characterized in that at least one of the white oil streams of step (c) comprises 75 mol percent or more linear di-alkyl naphthenes and linear alkyl naphthenes.

3. The process of claim 1 further characterized in that at least one of the white oil streams of step (c) has a viscosity of from about 40 to 100 centistokes and a viscosity index of from about 50 to 110 according to American Society for Testing Materials standard method D 567-53.

4. The process of claim 1 further characterized in that at least a portion of the light alkylate stream is recycled to the alkylation zone.

5. The process of claim 4 further characterized in that said alkylation comprises two or more distinct reactors each of which operates at a different olefin to aromatic molar ratio, and in that said portion of the light alkylate stream which is recycled to the alkylation zone is passed to the reactor operating at the highest olefin to aromatic molar ratio.

6. A process for the production of white oil, which comprises:

(a) dehydrogenating linear paraffinic hydrocarbons of a dehydrogenation feed stream comprising linear paraffinic hydrocarbons and which contains essentially no sulfur or nitrogen in a dehydrogenation zone maintained at dehydrogenation conditions to produce a dehydrogenation zone effluent stream comprising hydrogen, linear mono-olefinic hydrocarbons and dienes;

(b) separating the dehydrogenation reactor effluent stream in a first separation zone to produce at least a first overhead stream which comprises hydrogen and a first bottoms stream which is essentially sulfur-free and nitrogen-free and which comprises mono-olefinic hydrocarbons and dienes, and passing the first bottoms stream to a diene reduction zone;

(c) reducing dienes to mono-olefinic hydrocarbons or to paraffins in the diene reduction zone which operates at conditions that result in essentially no hydrocracking, to produce a diene reduction zone effluent stream;

(d) alkylating aromatic hydrocarbons with mono-olefinic hydrocarbons of the diene reduction zone effluent stream in an alkylation zone maintained at alkylating conditions to produce an alkylation zone effluent stream;

(e) separating the alkylation zone effluent stream in a second separation zone to produce at least a first alkylate stream comprising linear mono-alkyl aromatics and a second alkylate stream comprising linear di-alkyl aromatics as a major component, and passing the second alkylate which comprises essentially no sulfur or nitrogen stream to an aromatic-saturation zone;

(f) saturating aromatics which contain essentially no sulfur or nitrogen in the aromatic saturation zone at conditions which result in essentially no hydrocracking to produce an aromatic-saturation zone effluent stream; and (g) fractionating the aromatic-saturation zone effluent stream to produce one or more white oil streams, where at least one of the white oil streams has a viscosity of from about 40 to 100 cst and a viscosity index of about 50 to 110 according to American Society for Testing Materials standard method D567-53.

7. The process of claim 6 further characterized in that at least a portion of the first alkylate stream is returned to the alkylation zone.

8. The process of claim 6 further characterized in that one or more of the white oil streams of step (g) contains more than about 75% mol percent dialkyl-naphthenes.

9. The process of claim 6 further characterized in that all of the second alkylate stream is passed to the aromatic saturation zone.

10. The process of claim 6 further characterized in that the first overhead stream is divided into portions with a first portion being passed to the diene reduction zone and a second portion being passed to the aromatic-saturation zone.

11. The process of claim 6 further characterized in that one or more of the white oil streams of step (g) has a viscosity within the range of from about 80 to 120 and a viscosity index within the range of from about 50 to 100 according to American Society for Testing Materials Standard method D 567-53.

12. The process of claim 6 further characterized in that said alkylation zone comprises reactors operating at different olefin to aromatic molar ratios and in that said light alkylate is not recycled to the reactor operating at the lowest olefin to aromatic molar ratio.

13. The process of claim 6 further characterized in that the second alkylate stream comprises 5% percent or more by weight of total net products from the alkylation zone.

14. The process of claim 6 further characterized in that the second alkylate stream comprises more than 20 percent aromatics by mols.

15. The process of claim 14 further characterized in that the second alkylate stream comprises more than 50 percent aromatics by mols.

* * * * *